US006356171B2

(12) United States Patent
Fiedziuszko et al.

(10) Patent No.: US 6,356,171 B2
(45) **Date of Patent: *Mar. 12, 2002**

(54) PLANAR GENERAL RESPONSE DUAL-MODE CAVITY FILTER

(75) Inventors: Slawomir J. Fiedziuszko; George A. Fiedziuszko, both of Palo Alto, CA (US)

(73) Assignee: Space Systems/Loral, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/277,811

(22) Filed: Mar. 27, 1999

(51) Int. Cl.[7] ..... H01P 1/20; H01P 3/12; H01P 7/06

(52) U.S. Cl. ..... 333/212; 333/227; 333/230

(58) Field of Search ..... 333/202, 206, 333/207, 208, 212, 227, 230

(56) References Cited

U.S. PATENT DOCUMENTS

| | | | | |
|---|---|---|---|---|
| 2,406,402 A | | 8/1946 | Ring | 333/232 |
| 3,475,642 A | | 10/1969 | Karp et al. | 315/3.5 |
| 3,516,030 A | | 6/1970 | Brumbelow | 333/212 |
| 3,680,012 A | | 7/1972 | Moreau | 333/212 |
| 4,135,133 A | | 1/1979 | Mok | 333/73 W |
| 4,216,448 A | | 8/1980 | Kasuga et al. | 333/203 |
| 4,267,537 A | | 5/1981 | Karmel | 333/231 |
| 4,453,146 A | * | 6/1984 | Fiedziuszko | 333/212 |
| 4,489,293 A | * | 12/1984 | Fiedziuszko | 333/202 |

OTHER PUBLICATIONS

S. J. Fiedziuszko and R. C. Chapman "Miniature Filters and Equalizers Utilizing Dual Mode Dielectric Resonator Loaded Cavities", 1982 International Microwave Symposium, IEEE MTT, Jun. 15–17, 1982.

* cited by examiner

*Primary Examiner*—Robert Pascal
*Assistant Examiner*—Kimberly E Glenn
(74) *Attorney, Agent, or Firm*—Kenneth W. Float

(57) ABSTRACT

An electromagnetic cavity filter is formed by at least two cavities having electrically conductive walls. Each cavity is the equivalent of two filter poles because two orthogonal modes of electromagnetic radiation can resonate within each cavity. Characterizing vector tuning elements are coupled to each of the cavities that are each aligned along respective axes. The tuning elements are used to provoke derivative orthogonal modes and determine the degree of coupling between orthogonal modes. One or more intercavity couplers interconnect the cavities and are rotated at arbitrary angles that are different from the axes of the characterizing vector tuning elements. Electrically adjacent and nonadjacent modes of proximate cavities can be coupled, permitting elliptic filter functions. Electrically nonadjacent modes are coupled by means of an iris interconnecting the two cavities. Electrically adjacent modes are coupled by means of an electrically conductive probe penetrating each of the cavities. A dielectric resonator may be disposed within each cavity to reduce the physical size of the cavity while preserving its electrical characteristics. Input and output coupling elements, coupled to selected cavities may be disposed at locations that are angularly rotated with respect to a corresponding characterizing vector tuning element by a selectable angle that varies between 0 and ±180 degrees.

18 Claims, 4 Drawing Sheets

PLANAR GENERAL RESPONSE DUAL-MODE CAVITY FILTER

BACKGROUND

The present invention relates generally to filters, and more particularly, to planar general response dual-mode cavity filters that may be used to produce microwave, high performance filters and multiplexers for satellite and wireless system applications.

Prior art generally relating to the present invention relates to cavity and single mode dielectric resonator filters, and includes the following:

U.S. Pat. No. 4,489,293 assigned to the assignee as the present invention, discloses a dual mode filter comprising several collinear dielectric loaded resonant cavities with their successive endwalls coupled. In the present invention, on the other hand, it is sufficient that the angle formed by the midpoints of any three proximate cavities is an integral multiple of 90° and the sidewalls, not the endwalls, of the cavities are coupled. U.S. Pat. No. 4,489,293 uses iris or probe couplers between proximate cavities but does not suggest the use of a combined iris and probe coupling the same two cavities as in the present invention.

The device disclosed in U.S. Pat. No. 4,489,293 is mechanically difficult to mount and assemble, particularly in applications such as satellite transponders where complicated bracketing is necessary. Furthermore, the space between the cylindrically-shaped filter and surrounding planar equipment is not fully utilized. An optimum canonic filter realization for equal or greater than 6 poles requires an input and an output to be located in the same cavity; isolation between these two ports is difficult to achieve.

The present invention offers the following advantages. It is compatible with miniature MIC devices and is mechanically easier to mount. Integration with equalizers and isolators in the same housing is made possible. Because the cavities can follow a geometrically folded pattern, a realization of an optimum canonic response is easily achievable. Because of its larger heatsinking cross-section, the present invention has better heat transfer characteristics, especially in a vacuum environment. Therefore, application at higher power levels is possible.

U.S. Pat. No. 4,489,293 is elaborated upon in an article by S. J. Fiedziuszko and R. C. Chapman entitled "Miniature Filters and Equalizers Utilizing Dual Mode Dielectric Resonator Loaded Cavities", 1982 International Microwave Symposium, IEEE MTT, Jun. 15–17, 1982.

U.S. Pat. No. 4,216,448 discloses an "engine block" filter comprising several cavities. However, the patent uses a single coaxial TEM mode, and does not suggest the dual mode operation of the present invention. Dual mode operation allows the number of poles in the filter to be doubled because two modes resonate simultaneously within the same cavity, and one pole corresponds to each mode. This is very important in applications where weight and size are critical, such as in spacecraft. The filter of U.S. Pat. No. 4,216,448 is capable of coupling electrically adjacent modes only, not electrically nonadjacent modes as in the present invention. U.S. Pat. No. 4,216,448 does not suggest the use of dielectric resonators as in the present invention. The tuning screws of the filter of U.S. Pat. No. 4,216,448 protrude through the endwalls, not sidewalls as in the present invention. U.S. Pat. No. 4,216,448 does not suggest the use of a combined iris and probe coupler.

U.S. Pat. No. 4,135,133 discloses a collinear dual mode filter. It does not show combined iris/probe intercavity couplers. It does not show dielectric loading and does not show how one can geometrically fold the filter as in the present invention.

U.S. Pat. No. 4,267,537 discloses a circular $TE_{0\ mm}$ mode sectorial filter, not a dual mode folded geometry cavity filter as is the present invention.

U.S. Pat. No. 3,516,030 discloses a hole in conjunction with a rod between two cavities and. The hole is not an iris because it does not interconnect the two cavities.

Other general references include U.S. Pat. Nos. 2,406,402, 3,475,642, and 3,680,012.

With regard to the most relevant prior art, U.S. Pat. 4,453,146 issued to Fiedziuszko and assigned to the assignee of the present invention, discloses an electromagnetic cavity filter is formed by at least two cavities having electrically conductive walls. When more than two cavities are employed, their midpoints do not have to be collinear; rather, it is sufficient that the angle formed by the midpoints of any three successively coupled cavities is an integral multiple of 90°. Thus, a folded "engine block" geometry can be realized such that the filter's input cavity is proximate to the output cavity. This allows a canonic filter response. Each cavity is the equivalent to two filter poles because two orthogonal modes of electromagnetic radiation can resonate therewithin. Electrically nonadjacent modes of proximate cavities, as well as electrically adjacent modes, can be coupled, permitting elliptic filter functions. Electrically nonadjacent modes are coupled by means of an iris opening between the two cavities. Electrically adjacent modes are coupled by means of an electrically conductive probe penetrating each of the two cavities. A dielectric resonator can be disposed within each cavity to reduce the physical size of the cavity while preserving its electrical characteristics.

While the filter disclosed in U.S. Pat. 4,453,146 was a significant improvements in the filter art, the present inventors have developed a more generalized filter than is disclosed in this patent that provides for variable input/output coupling and which is readily adaptable to many filter applications.

Accordingly, it would be advantageous to have improved planar general response dual-mode cavity filters. It would also be advantageous to have improved planar general response dual-mode dielectric loaded cavity filters.

SUMMARY OF THE INVENTION

The present invention provides for an improvement to the filter technology disclosed in U.S. Pat. 4,453,146, and provides for a planar general response dual-mode (dielectric loaded) cavity filter that is more adaptable than the filters disclosed in this patent. The present planar general response dual-mode cavity filter, which may be dielectrically loaded, enables realization of steeper response filters and asymmetric response filters in a dual mode filter configuration, which is not achievable using the technology disclosed in U.S. Pat. 4,453,146 or in other conventional filter designs. The present invention provides for the construction of improved microwave, high performance filters and multiplexers for use in satellite and wireless system applications.

The present invention provides for a device that filters electromagnetic radiation, comprising two or more resonant, generally cylindrical cavities. Angles connecting midpoints of any three proximate cavities can be any integral multiple of 90°, permitting a geometric folded, or block arrangement, in which the cavity accepting a filter input by way of an input element or input coupling apparatus is proximate to two other cavities, with one of the two other cavities generating a filter output by way of an output element or output coupling apparatus. Sidewalls of the cavities are intercoupled by means of probes and/or irises.

Resonating within each cavity can be two orthogonal degenerate modes of electromagnetic energy, i.e., $HE_{111}$ waveoguide modes. Intercavity coupling is achieved by an iris, a probe, or a combination iris and probe coupling two adjacent cavities. Two electrically nonadjacent modes are coupled by an inductive iris. Two electrically adjacent modes are coupled by a capacitive probe. Each cavity may be loaded with a dielectric resonator to reduce the size and weight of the filter. Each cavity has characterizing vector tuning elements, which are typically tuning screws. Each cavity also has a mode coupling element, which also may be the form of a tuning screw. One cavity has an input element and a second cavity has an output element, which may be probes or irises.

Coupling irises or probes are selectively rotated at an angle with respect to a line through centers of adjacent intercoupled cavities. This rotation of the coupling irises or probes create additional mode couplings between the intercoupled cavities. The input and output elements may also be selectively rotated at an angle with respect to an axis that is perpendicular to a sidewall of each respective cavity. The input and output coupling apparatus or coupling elements may be disposed at locations that are angularly rotated with respect to the corresponding characterizing vector tuning element by a selectable angle that varies between 0 and ±180 degrees.

The use of dual mode cavities allows for two filter poles per cavity. Compared with single mode filters, the present invention thus offers an approximate doubling in filter capability for the same weight and size.

The present invention offers mechanical mounting advantages compared with dual mode collinear filters, and can be readily integrated with other components, such as equalizers and isolators, in the same housing. Because of the geometrically folded, block design, a realization of optimum canonic response is easily achievable.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
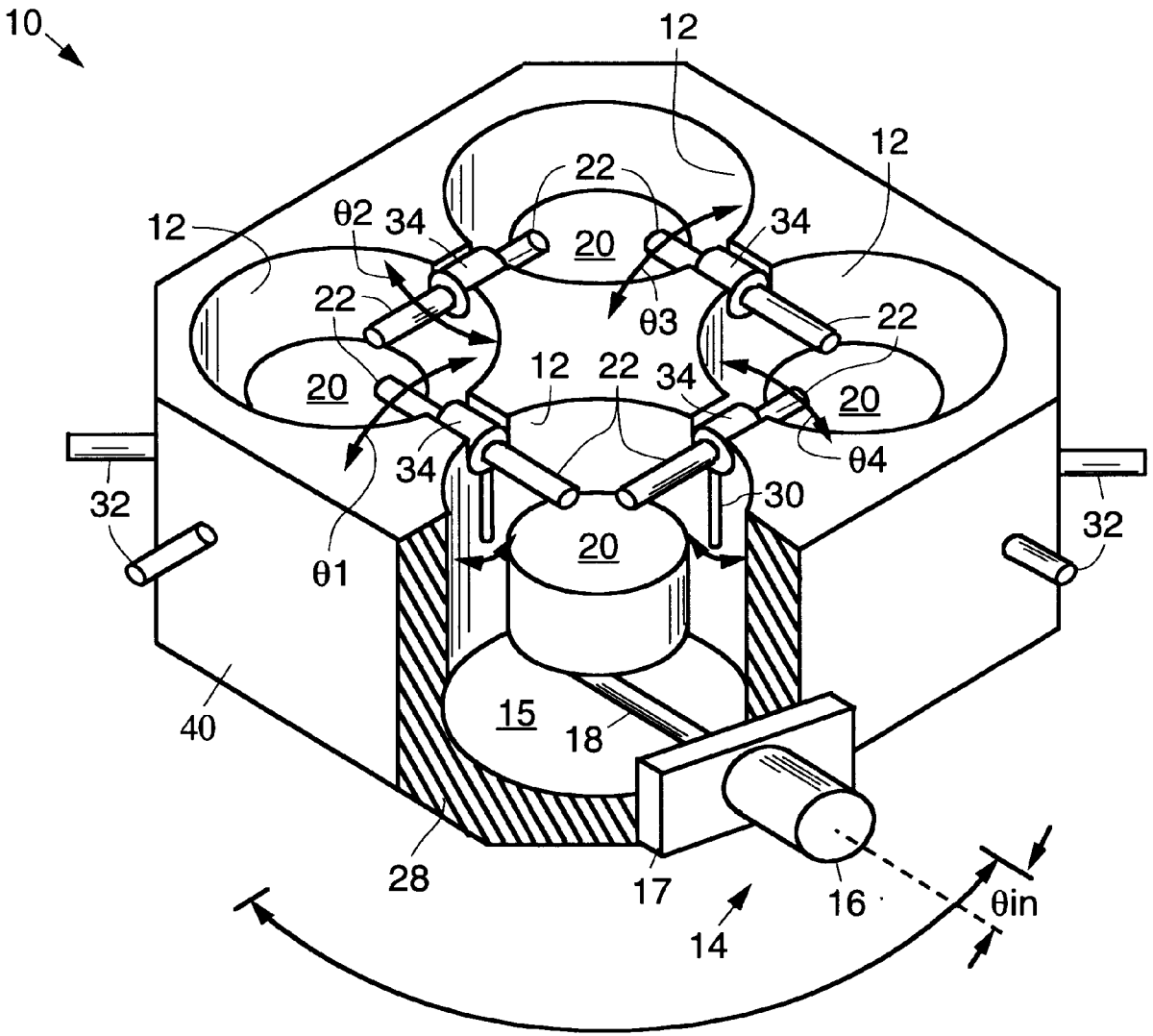
FIG. 1 is an elevated isoplanar view, partially in cross-section, of an embodiment of a planar general response dual-mode dielectric loaded cavity filter in accordance with the principles of the present invention.

Referring to the drawing figures, FIG. 1 is an elevated isoplanar view, partially in cross-section, of an exemplary embodiment of a dual-mode dielectric loaded cavity filter 10 in accordance with the principles of the present invention. The filter 10 comprises at least two cavities 12. FIG. 1 shows an exemplary embodiment of a filter 10 with four cavities 12.

The exemplary filter 10 has a housing 28, which in the illustrated embodiment is roughly in the shape of a cubical block, in which four substantially identical cavities 12 are formed. Each cavity 12 has a generally cylindrical shape formed by upper and lower endwalls 15 interconnected by a generally cylindrical-sleeve-shaped sidewall 40. For ease of illustration, the filter 10 is shown in FIG. 1 with its top sliced off, so that the upper endwalls 15 are not seen. Each endwall 15 is substantially orthogonal to its associated sidewall 40. Each endwall 15 has a shape that remains constant when the endwall 15 is rotated in its own plane by an integral multiple of 90°.

A "longitudinal axis" of a cavity 12 is defined as an axis perpendicular to the endwalls 15 and parallel to the sidewall 40. The longitudinal axes of all cavities 12 in the filter 10 are generally parallel, with all upper endwalls 15 lying in substantially one plane and all lower endwalls 15 lying in substantially another plane. Thus, the cavities 12 are sidewall-proximate rather than endwall-proximate. "Proximate" as used herein means having a separation less than the distance of an endwall 15 radius. The cavities 12 are close enough to facilitate coupling but not so close as to offset the mechanical integrity of the housing 28 or allow leakage of electromagnetic energy between cavities.

One of the cavities 12, in this case the frontmost cavity 12, is shown having an input element 14 or input port 14 that provides a path to input energy into the filter 10. Any of the other cavities 12 may contain an input port 14*a* or output port 14*a* (FIGS. 2, 3 and 7) to output energy from the filter 10. The input and output elements 14, 14*a*, or ports 14, 14*a*, may be selectively rotated at an angle with respect to an axis that is perpendicular to a sidewall 40 of each respective cavity 12. (More specifically, the input and output elements 14, 14*a*, may be disposed at locations that are angularly rotated with respect to a corresponding characterizing vector tuning element 32 by a selectable angle that varies between 0 and ±180 degrees, as will be more fully described below.

The input port 14 can be any element that couples to an electromagnetic resonant cavity 12 with an exterior environment. For illustrative purposes, the input port 14 is shown as a coaxial coupler having a cylindrical outer conductor 16, a dielectric mounting plate 17, and an inner conductive probiscus 18, or probe 18, extending into the cavity 12. Tuning and coupling elements or screws 32 (32*a*, 32*b*, 32*c*) protrude through sidewalls 40 of the cavities 12 for provoking derivative orthogonal modes and for determining the degree of coupling between orthogonal modes, as will be more fully described below.

Each cavity 12 can have a dielectric resonator 20 within its interior, preferably having a high dielectric constant and a high Q. The dielectric resonators 20 allow for a physical shrinking of the filter 10 while retaining the same electrical characteristics, which is important in applications where filter weight and size are critical, such as in a spacecraft, for example. Each resonator 20 exhibits substantially the same dielectric effect. Therefore, it is convenient for all resonators 20 to have substantially the same size and shape (illustrated in FIG. 1 as a right circular cylindrical), and have substantially the same dielectric constant.

When the resonators 20 are employed, the midpoint of each resonator 20 does not have to be situated along the midpoint of the longitudinal axis of the cavity 12. However, the longitudinal axis of the resonator 20 should be parallel to the longitudinal axis of the cavity 12. In any plane orthogonal to these two axes and bifurcating both the cavity 12 and the resonator 20, the shape of the resonator 20 cross-section and the cavity 12 cross-section should be the same (the size of the resonator 20 cross-section is less than or equal to that of the cavity 12 cross-section), and the resonator 20 cross-section should be centered within the cavity 12 cross-section.

The cross-section of the resonator 20 and the cross-section of the cavity 12 should both satisfy the rule that their common shape remains unchanged following rotation in this bifurcating plane by an integral multiple of 90°. Thus, this common shape may be a circle, square, octagon, etc. The resonator 20 is kept in place within the cavity 12 by a material having a low dielectric constant, such as Styrofoam, or by a metal or dielectric screw (or other means) disposed along the cylindrical axis of the resonator 20 and the cavity 12.

The insertion loss of the filter 10 is determined by Q-factors of the individual dielectric resonator loaded cavities 12, which in turn depend upon the loss of the dielectric resonator material and the material used to position the resonator 20 within the cavity 12.

Given the folded block geometry illustrated in FIG. 1, canonic filters 10, in which the filter's input cavity 12 is coupled to the output cavity 12, can be attained. FIG. 1 does not show an output port 14*a* (FIGS. 2, 3 and 7), but the leftmost cavity 12 or the rightmost cavity 12 may serve as an output cavity 12 by having an output port 14*a* coupled thereto, output port 14*a* port would be obscured in FIG. 1 if it were on one of the two back sidewalls 40 or on the bottom of housing 28.

Coupling between two proximate cavities 12 may be accomplished using an inductive iris 30, which is an opening connecting the two cavities 12, by a capacitive conductive probe 22 penetrating the two cavities 12, or by a combination of an iris 30 and a probe 22. There is no requirement that the midpoint of the probe 22 and/or inductive iris 30 be halfway along the longitudinal axis of the cavities 12 that are coupled thereby. Each probe 22 couples two electrically adjacent modes 12, while each iris 30 couples two electrically nonadjacent cavities 12. This is explained in more detail below.

The probe 22 is an elongated electrically conductive member extending into both cavities 12 coupled thereby. The probe 22 is insulated from the electrically conductive cavity 12 walls 40 using a cylindrical dielectric sleeve 24 surrounding the probe 22 and fitting into a cylindrical notch 34 cut into the housing 28. The length of the probe 22 depends upon the desired electrical characteristics. A longer probe 22 increases the bandwidth, and vice versa. The exact length of the probe 22 is typically determined experimentally. In accordance with the present invention, the probe 22 is selectively rotated at an angle (θ1, θ2, θ3, θ4) with respect to a line through centers of adjacent intercoupled cavities 12. The rotation of the coupling probes 22 creates additional mode couplings between the intercoupled cavities 12.

If the resonator 20 and the probe 22 are both employed, decreasing the distance between them causes an increase in the sensitivity of the electrical characteristics with respect to reproducibility of results, temperature variations, and mechanical vibration.

The iris 30 is an elongated opening aligned along the longitudinal axis of and interconnecting the two cavities 12 coupled thereby. The width of the iris 30 depends upon the desired electrical characteristics. The wider the iris 30, the wider the bandwidth of the resulting filter section. In accordance with the present invention, the iris 30 is selectively rotated at an angle about a horizontal axis through the iris 30 so that it is not parallel to a vertical axis of either adjacent intercoupled cavity 12.

When a probe 22 and an iris 30 are used together to couple the same two cavities 12, the iris 30 may or may not be bifurcated by the probe 22. When it is so bifurcated, its length should be shortened slightly to retain the same electrical characteristics.

Figure 2:
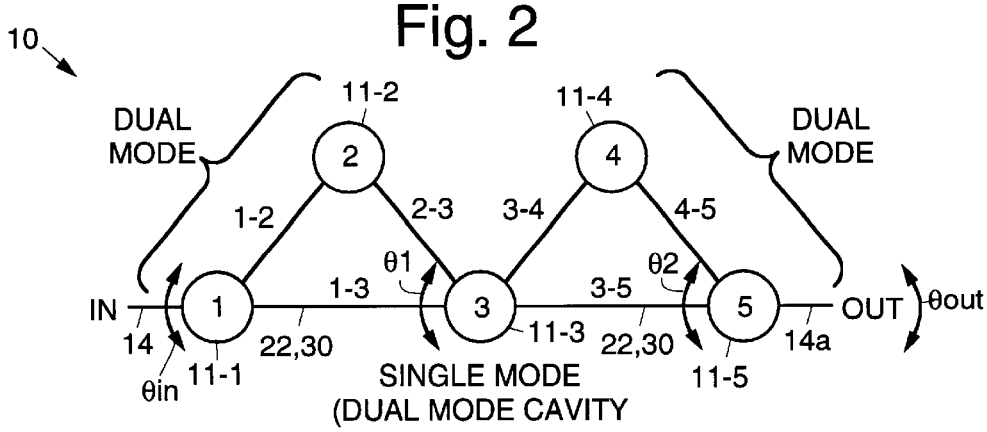
FIG. 2 illustrates an exemplary coupling diagram for a five pole filter in accordance with the principles of the present invention.

FIG. 2 illustrates an exemplary coupling diagram for a five pole filter 10 in accordance with the principles of the present invention. The exemplary five pole filter 10 has three intercoupled cavities 12, an input port 14 coupled to the first cavity 12, and an output port 14*a* coupled to the third cavity 12. Dual modes are supported by the first and third cavities 12. Dual mode couplings are provided as is illustrated by the coupling between modes 1 and 2 (between encircled numbers 1 and 2) and the coupling between modes 2 and 3 (between encircled numbers 1 and 2). Additional dual mode couplings are provided as is illustrated by the coupling between modes 3 and 4 (between encircled numbers 3 and 5) and the coupling between modes 4 and 5 (between encircled numbers 4 and 5). A single mode is supported by the second cavity 12 and is illustrated by the couplings from modes 1 and 3 and from modes 3 and 5.

Figure 3:
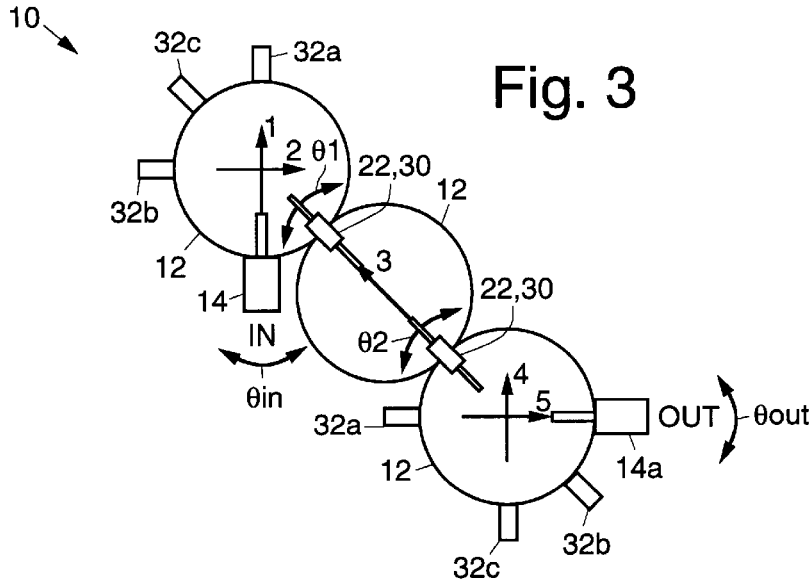
FIG. 3 illustrates a physical configuration of the five pole filter shown in the coupling diagram of FIG. 2.

The coupling irises 30 or probes 22 are rotated at an angle with respect to axes of the characterizing vector tuning elements (tuning screws 32 in FIG. 1) to create the additional mode couplings. The input and output ports 14, 14*a* may be rotated with respect to axes through the corresponding characterizing vector tuning elements (tuning screws 32). The input and output ports 14, 14*a*, may be disposed at locations that are angularly rotated with respect to the corresponding characterizing vector tuning element 32 by a selectable angle that varies between 0 and ±180 degrees FIG. 3 illustrates a physical configuration of the five pole filter 10 shown in the coupling diagram of FIG. 2. The exemplary five pole filter 10 comprises a first dual mode cavity 12 having an input port 14, first and second tuning screws 32*a*, 32*c*, which comprises characterizing vector tuning screws 32, and a mode coupling screw 32*b*. The input port 14 is at an arbitrary angle between 0 and 90 degrees with respect to an axis defined by the characterizing vector tuning screw 32*a*.

The first cavity 12 is coupled by way of a first coupling iris 30 and/or first coupling probe 22 to a second cavity 12. The first coupling iris 30 and/or first coupling probe 22 are also disposed at an arbitrary tangle between 0 and 90 degrees with respect to an axis defined by the characterizing vector tuning screw 32*a*. The angle of the first coupling iris 30 and/or first coupling probe 22 is typically not the same as the angle of the input port 14.

The second cavity is coupled by way of a second coupling iris 30 and/or coupling probe 22 to a third cavity 12. The third cavity 12 has an output port 14*a* tat is disposed at an arbitrary angle between 0 and 90 degrees with respect to an axis defined by the characterizing vector tuning screw 32*a* (not shown) in the its cavity 12. The second coupling iris 30 and/or coupling probe 22 is also disposed at an arbitrary angle between 0 and 90 degrees with respect to an axis defined by the characterizing vector tuning screw 32*a*. The angle of the second coupling probe 22 is typically not the same as the angle of the input port 14, the first coupling iris 30 and/or probe 22, or the output port 14*a*.

As is shown in FIG. 3, the first cavity 12 supports dual modes as is illustrated by the horizontal and vertical arrows marked 1 and 2. The second cavity 12 supports a single mode illustrated by the 45 degree arrows marked 3. The coupling iris 30 and/or coupling probe 22 between the first and second cavities 12 is rotated at an angle that supports coupling of modes 1–3 and 2–3. The third cavity also supports dual modes as is illustrated by the horizontal and vertical arrows marked 4 and 5. The coupling iris 30 and/or coupling probe 22 between the second and third cavities 12 is rotated at an angle that supports coupling of modes 3–4 and 3–5.

Figure 4:
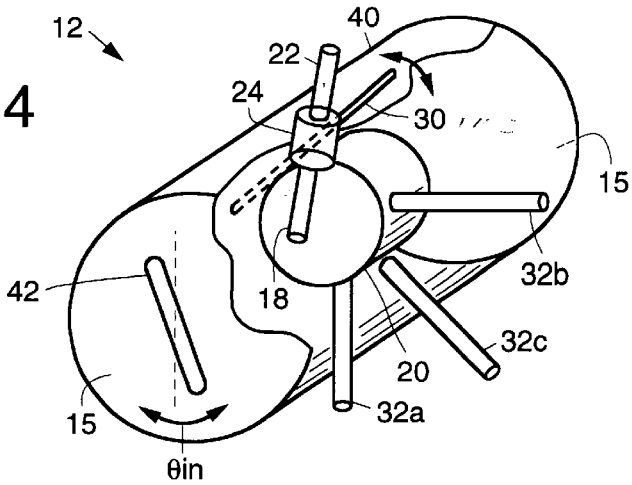
FIG. 4 is one embodiment of an individual cavity of the present invention.

FIG. 4 shows details of one embodiment of a cavity 12 suitable for use in the filter 10 shown in FIG. 1. An input iris 42, which is an elongated slot cut into an endwall 15 of the cavity 12, serves as the input port 14 or output port 14*a* to the cavity 12. Other types of ports 14, 14*a* may be used, as is well known in the art. The input iris 42 is rotated at an arbitrary angle between 0 and 90 degrees with respect to an axis defined by the characterizing vector tuning screw 32*a*. The inside surfaces of the walls 40, 15 are electrically conductive. This may be achieved, for example, by sputtering a thin layer of silver or other conductive material onto a drilled-out lightweight dielectric housing 28.

Two intercavity couplers are illustrated in FIG. 4, including a probe 22 and an iris 30 disposed through the sidewall 40. The probe 22 and iris 30 are rotated at an angle so that the probe 22 is not perpendicular to the sidewall 40, and the iris 30 is not perpendicular to the longitudinal axis of the sidewall 40.

First and second tuning screws 32*a*, 32*b*, which may be dielectric and conductive, serve to perturb the electrical field distribution of modes propagating within the cavity 12. This perturbation may be accomplished in other ways, such as by indenting the sidewall 40 at the point of entry of the screws. The tuning screws 32*a*, 32*b* are orthogonal to each other. The tuning screws 32*a*, 32*b* are not collinear with the characterizing vector of the initial mode brought into the cavity 12, i.e., by the input port 42, because it is rotated relative to the axis of the first tuning screw 32*a*. The first tuning screw 32*a* controls this initial mode. The second tuning screw 32*b* controls the orthogonal mode, or derivative mode, which is provoked by the coupling screw 32*c*.

The function of each tuning screw 32*a*, 32*b* is to change the frequency of the mode defined by the characteristic vector, which in the present filter 10, is at an angle ($\theta$) with respect to each of the tuning screws 32*a*, 32*b* in the respective cavity 12. Inserting the tuning screw 32*a*, 32*b* further into the cavity 12 lowers the resonant frequency of that mode.

The coupling screw 32*c*, which may be dielectric and conductive, provokes the derivative mode and controls the degree of coupling between the initial mode and the derivative mode. The more the coupling screw 32*c* is inserted into the cavity 12, the more the derivative mode within the cavity 12 is excited.

FIG. 4 shows the penetration points of the tuning screws 32*a*, 32*b* grouped within the same 90° circumference of the sidewall 40, but this is not necessary, as long as the tuning screws 32*a*, 32*b* are orthogonal to each other and the coupling screw 32*c* forms substantially a 45° angle with respect to each of the tuning screws 32*a*, 32*b*. The tuning and coupling screws 32*a*, 32*b*, 32*c* are orthogonal to the sidewall 40.

Figure 5:
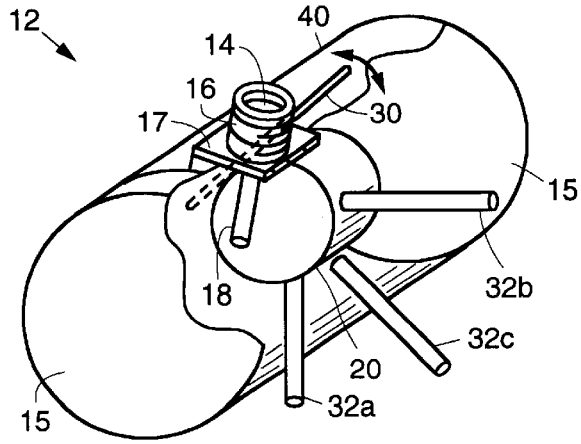
FIG. 5 is an alternative embodiment of an individual cavity of the present invention.

FIG. 5 illustrates an alternative embodiment of the cavity 12 in which the input or output function is performed by an input or output port 14, 14*a*, illustrated to be a coaxial coupler protruding through and rotated at an angle with respect to a sidewall 40. The input or output port 14, 14*a* includes an outer cylindrical conductor 16, a probiscus 18 extending into the cavity 12 and separated from the outer conductor 16 by dielectric, and a dielectric mounting plate 17. An intercavity coupling iris 30 is also shown disposed along the sidewall 40 at an angle relative to the axis of the cavity 12.

Figure 6:
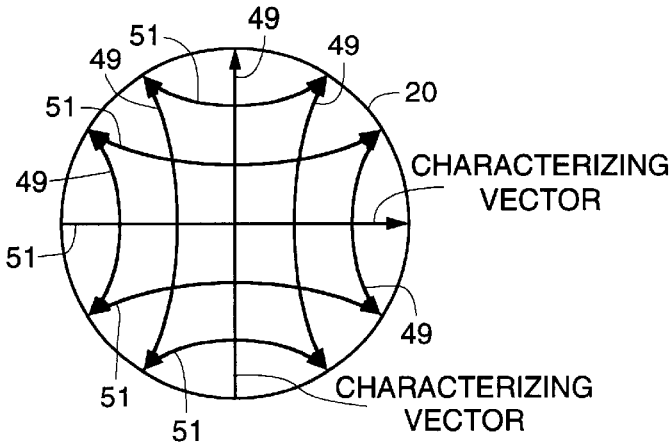
FIG. 6 is a sketch of the electric field distribution of a first electromagnetic mode within dielectric of a cavity of the present invention, and the electric field distribution of a second orthogonal mode.

FIG. 6 illustrates a cross-section of a dielectric resonator 20 showing two orthogonal modes resonating therewithin. A first mode is designated by arrows 49 and shows the general distribution of the electric field vectors defining the mode. A second, orthogonal mode is designated by arrows 51 and shows the electric field distribution of that mode.

Figure 7:
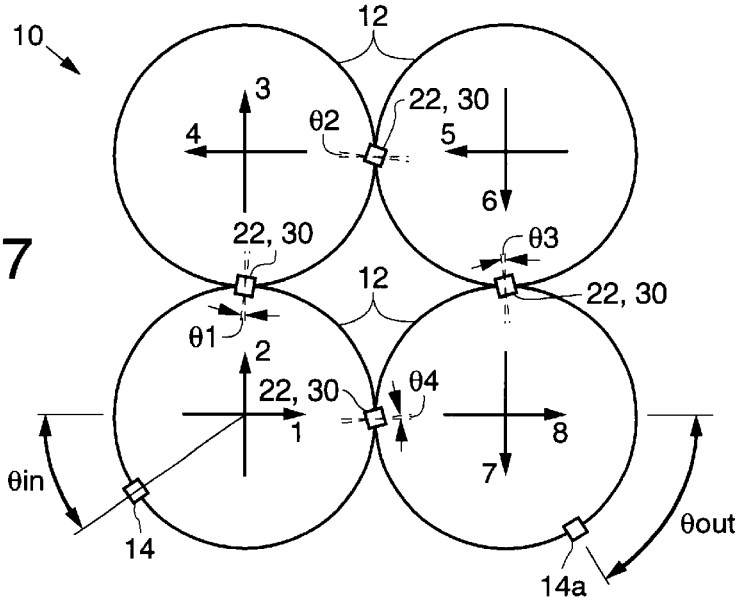
FIG. 7 is a sketch viewed from above of a four cavity embodiment of the present invention illustrating orthogonal mode characterizing vectors (1 through 8) within the cavities.

Each mode can be represented solely by its central vector, i.e., the straight arrow, identified as the "characterizing vector" for that mode. With reference to FIG. 7, each of four cavities 12 of the filter 10 is shown having two orthogonal modes therewithin. The modes are numbered 1 through 8 and are illustrated by their respective characterizing vectors (the arrows within the respective cavities 12).

The filter 10 in FIG. 7 has an input port 14, an output port 14*a* and four intercavity couplers comprising a probe 22, an iris 30, or both a probe 22 and an iris 30. If input electromagnetic energy enters the lower left cavity 12 via the input port 14, its initial mode of resonance is mode 1. The tuning screw 32*a*, 32*b* and mode coupling screws 32*c* are not shown in FIG. 7. A second, orthogonal mode, mode 2, is provoked within the first cavity 12. Given that one desires to excite modes 3 and 4 within the upper left cavity 12, mode 4 is electrically nonadjacent to mode 1, and mode 3 is electrically adjacent to mode 2. Then the intercavity coupler comprises a probe 22 and an iris 30.

As used throughout this description, "electrically adjacent modes" or "adjacent modes" are two modes resonating within proximate cavities 12, and whose characterizing vectors are both parallel and collinear. Thus, in FIG. 7, the following pairs of modes satisfy the definition of electrically adjacent modes: 2 and 3, 4 and 5, 6 and 7, and 8 and 1.

It is normally not desirable to couple together pairs of modes from proximate cavities 12 whose characterizing vectors are perpendicular. Under the above definitions, these pairs of modes are neither electrically nonadjacent nor electrically adjacent. Similarly, modes from the same cavity 12 and modes from non-proximate cavities 12 are neither electrically nonadjacent nor electrically adjacent.

As is well known in the art, in designing a filter 10 one combines several cavities 12 using a certain sequence of electrically adjacent and electrically nonadjacent mode couplings. These design goals are easily realized in the present invention, in which to couple a pair of electrically nonadjacent modes, one uses an iris 30 between the two associated proximate cavities 12. To couple electrically adjacent modes, a probe 22 is used between the two associated proximate cavities 12. To couple both the electrically nonadjacent and the electrically adjacent modes of the same two cavities 12, an iris 30 and a probe 22 are used between the cavities 12.

Thus, in FIG. 7, if it is desired to excite modes 1, 2, 3, 6, 7, and 8, mode 2 is excited as described below, and a probe 22 is used to excite mode 3, an iris 30 is used to excite mode 6, and a probe 22 is used to excite mode 7, and mode 8 is excited as described below. A probe 22 is used to couple electrically adjacent modes 1 and 8. Similarly, an iris 30 is used to couple electrically nonadjacent modes 2 and 7.

Figure 8:
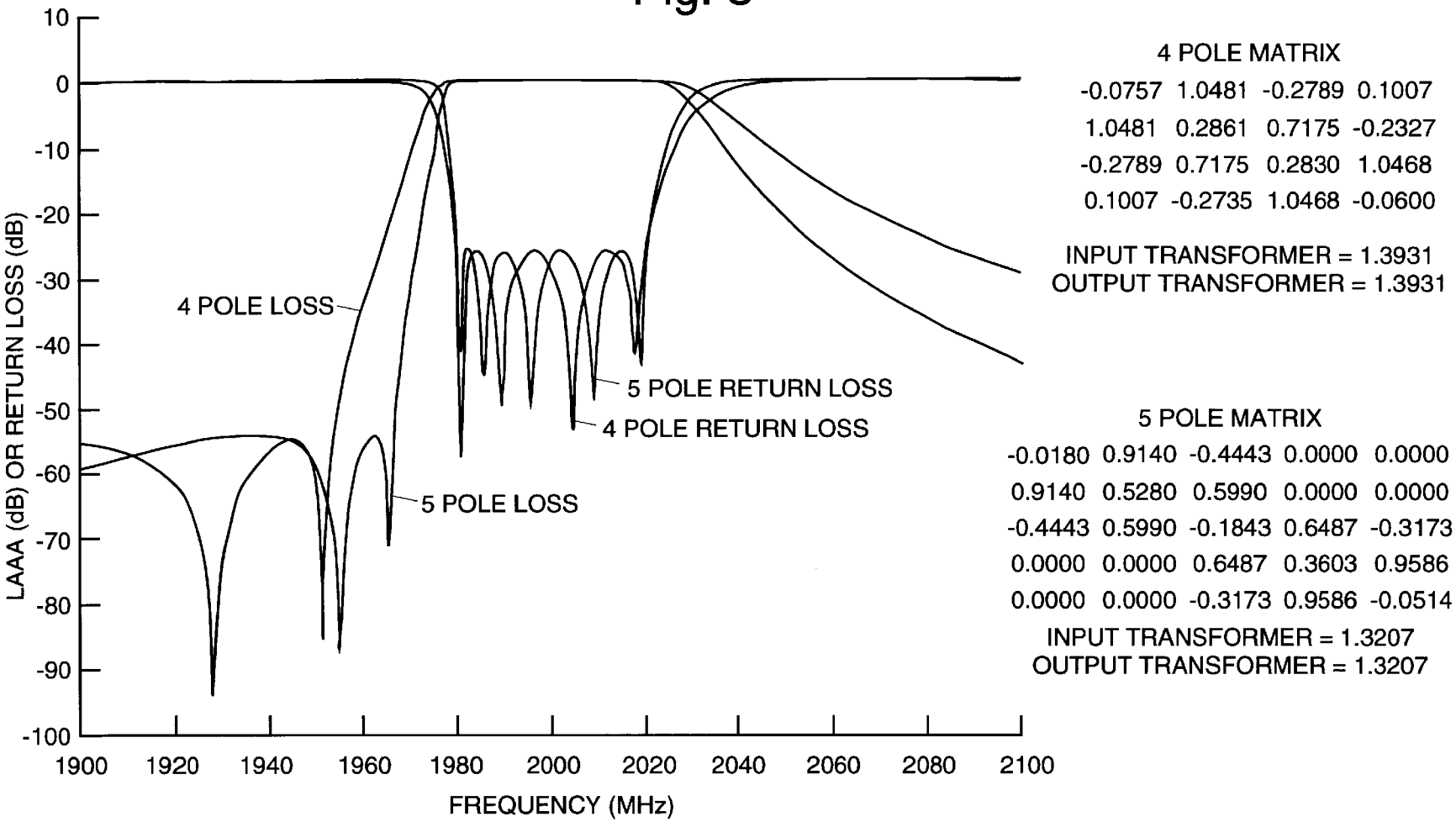
FIG. 8 shows graphs comparing losses for four and five pole filters in accordance with the principles of the present invention.

C-band filters 10 employing the above-described teachings have been designed, built and tested, including a 4-pole and several 5-pole filters 10. FIG. 8 shows graphs comparing 4-pole and 5-pole filters 10 in accordance with the principles of the present invention. FIG. 8 illustrates two curves showing loss in dB and two curves showing return loss in dB with respect to frequency in MHz, one for each respective filter 10. Data for four and five pole matrices defining the respective 4-pole and several 5-pole filters 10 is shown at the right of FIG. 8.

For the 5-pole filter, the probes 22 were cylindrical with diameters of approximately 1.3 mm and lengths of approximately 10.7 mm. Each of the four cavities 12 was 2 cm long with a diameter of 2.5 cm. Each dielectric resonator 20 was 0.68 cm along its longitudinal axis with a diameter of 1.6 cm. The irises 30 had lengths of approximately 20 mm and widths of approximately 2.5 mm. Weight of the 8-pole filter 10 was about 100 grams, about half the weight of comparable lightweight graphite fiber reinforced plastic collinear filters 10, and a third of the weight of thin-wall Invar collinear filters 10.

For the 4-pole filter 10, the cylindrical probes 22 had diameters of approximately 1.3 mm and lengths of approximately 1.9 mm. Each of the two cavities 12 had a length of 2 cm and a diameter of 2.5 cm. Each resonator 20 had a length of 0.68 cm and a diameter of 1.6 cm. The irises 30 had lengths of approximately 20 mm and widths of approximately 2.5 mm. The weight of the filter 10 was 60 grams. The insertion loss of the filer 10 was 0.2 dB (40 MHz equal ripple bandwidth), corresponding to a Q of about 8000. Spurious responses exhibited an adequate spacing (500 MHz). Selection of a larger diameter/length ratio for the dielectric resonators 20 would substantially improve this spacing.

Thus, improved planar general response dual-mode cavity filters have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An electromagnetic filter comprising:

two cavities that each support resonance of two orthogonal modes of electromagnetic energy;

an input element coupled to one of the cavities;

an output element coupled to the other of the cavities;

characterizing vector tuning elements coupled to each of the cavities that are each aligned along respective axes at first and second predetermined angles; and an intercavity coupler connecting the two cavities that couples a pair of electrically adjacent modes and a pair of electrically nonadjacent modes between the cavities, which intereavity coupler is disposed at an arbitrary angle with respect to the axes of the characterizing vector tuning elements, which arbitrary angle is different from the first and second predetermined angles of the axes of the characterizing vector tuning elements.

2. The filter recited in claim 1 wherein the input element is disposed at an angle between 0 degrees and ±180 degrees relative to the axis of its corresponding characterizing vector tuning elements.

3. The filter recited in claim 1 wherein the output coupling element is disposed at an angle between 0 and ±180 degrees relative to the axis of its corresponding characterizing vector tuning elements.

4. The filter recited in claim 1 wherein the input and output coupling apparatus are selected from a group including an elongated electrically conductive probe and an iris.

5. The filter recited in claim 1 wherein the intercavity coupler comprises an elongated iris between the two cavities and an elongated electrically conductive probe extending into each of the cavities.

6. The filter recited in claim 1 wherein the input element is selectively disposed at an angle with respect to an axis that is perpendicular to a sidewall of each respective cavity.

7. The filter recited in claim 1 wherein the output element is selectively disposed at an angle with respect to an axis that is perpendicular to a sidewall of each respective cavity.

8. The apparatus of claim 1 wherein within each cavity surrounds dielectric apparatus physically shrinks the size of the cavity while preserving its electrical characteristics.

9. An electromagnetic filter comprising:

at east three cavities that each support resonance of two orthogonal modes of electromagnetic energy, with adjacent pairs of cavities electromagnetically coupled via a common wall;

an input element coupled to one of the cavities;

an output element coupled to the other of the cavities;

each cavity surrounding a dielectric resonator;

characterizing vector tuning elements coupled to each of the cavities that are each aligned along respective axes at first and second predetermined angles; and intercavity couplers connecting respective pairs of cavities that couples a pair of electrically adjacent modes and a pair of electrically nonadjacent modes between the cavities, which intercavity couplers are respectively disposed at an arbitrary angle with respect to the axes of its corresponding characterizing vector tuning element, wherein at least one of the intercavity couplers is disposed at an angle that is different from the first and second predetermined angles of the axes of its corresponding characterizing vector tuning elements.

10. The filter recited in claim 9 wherein the input element is disposed at an angle between 0 degrees and ±180 degrees relative to the axis of its corresponding characterizing vector tuning elements.

11. The filter recited in claim 9 wherein the output coupling element is disposed at an angle between 0 and ±180 degrees relative to the axis of its corresponding characterizing vector tuning elements.

12. The filter recited in claim 10 wherein each pair of coupled cavities is coupled by an intercavity coupler comprising an elongated iris in a common wall and an electrically conductive probe protruding into each of the coupled cavities.

13. The filter recited in claim 10 wherein the respective input and output coupling elements are selected from a group including an elongated electrically conductive probe and an iris.

14. An electromagnetic filter comprising:

first and second electrically conductive cavities that share a common wall, and wherein two orthogonal modes of electromagnetic energy can resonate within each cavity;

first tuning apparatus disposed along a first axis of each cavity at a first predetermined angle for tuning each respective cavity to resonance at a first frequency;

second tuning apparatus disposed along a second axis of each cavity at a second predetermined angle that is substantially orthogonal to the first axis for tuning each respective cavity to resonance at a second frequency;

mode coupling apparatus disposed in each of the cavities for causing mutual coupling between resonant energy on the first and second axes to cause resonant energy on either of the axes to couple to and excite resonant energy on the other of the axes;

an intercavity coupler interconnecting the first and second cavities for coupling a pair of electrically adjacent modes and a pair of electrically nonadjacent modes between the cavities, which intercavity coupler is disposed at an arbitrary angle with respect to the axes of the first and second tuning apparatus, which arbitrary angle is different from the first and second predetermined angles of the axes of the first and second tuning elements; and input and output coupling apparatus for respectively coupling energy into the first cavity and out of the second cavity.

15. The filter recited in claim 14 wherein the input coupling apparatus is disposed at an angle between 0 degrees and ±180 degrees relative to the axis of its corresponding characterizing vector tuning elements.

16. The filter recited in claim 14 wherein the output coupling apparatus is disposed at an angle between 0 and ±180 degrees relative to the axis of its corresponding characterizing vector tuning element.

17. The filter recited in claim 14 wherein the input and output coupling apparatus are disposed at first and second selectable angles between the first and second axes for respectively coupling energy into the first cavity and out of the second cavity to provide for a filter having adjustable input/output coupling.

18. The filter recited in claim 15 wherein the respective input and output coupling apparatus is each selected from a group including an elongated electrically conductive probe and an iris.

* * * * *